US007747379B2

(12) United States Patent
Kita

(10) Patent No.: US 7,747,379 B2
(45) Date of Patent: Jun. 29, 2010

(54) CONTROL DEVICE OF DIRECT INJECTION INTERNAL COMBUSTION ENGINE

(75) Inventor: Masayuki Kita, Kariya (JP)

(73) Assignee: DENSO CORPORATION, Kariya (JP)

( * ) Notice: Subject to any disclaimer, the term of this patent is extended or adjusted under 35 U.S.C. 154(b) by 101 days.

(21) Appl. No.: 12/264,367

(22) Filed: Nov. 4, 2008

(65) Prior Publication Data

US 2009/0118986 A1 May 7, 2009

(30) Foreign Application Priority Data

Nov. 7, 2007 (JP) ..... 2007-290224

(51) Int. Cl.
*F02P 5/15* (2006.01)
*F02P 15/08* (2006.01)

(52) U.S. Cl. ..... 701/105; 123/406.47; 123/406.51; 123/636; 123/637

(58) Field of Classification Search ..... 701/105; 123/406.24, 406.25, 406.46, 406.47, 406.5, 123/406.51, 406.53, 406.54, 636, 637
See application file for complete search history.

(56) References Cited

U.S. PATENT DOCUMENTS 6,085,733 A * 7/2000 Motoyama et al. ..... 123/636
6,397,827 B1 * 6/2002 Kato et al. ..... 123/638
6,425,371 B2 * 7/2002 Majima ..... 123/406.24
6,708,661 B1 3/2004 Aubourg et al.
6,814,049 B2 * 11/2004 Vogel et al. ..... 123/305
7,647,914 B2 * 1/2010 Kim et al. ..... 123/299

FOREIGN PATENT DOCUMENTS

JP 2000-130214 5/2000

* cited by examiner

*Primary Examiner*—Erick Solis
(74) *Attorney, Agent, or Firm*—Nixon & Vanderhye PC

(57) ABSTRACT

When engine rotation speed is increasing in a compression stroke injection mode, a control device determines that a crank angle at injection end timing of an injector deviates toward a delayed crank angle side and performs additional ignition at timing when (or immediately before or after) a crank angle at actual injection end timing of the injector of a present injection cylinder is reached. Thus, even when the crank angle at the injection end timing deviates toward the delayed crank angle side with respect to preset original ignition timing, a combustion state can be stabilized by performing the additional ignition at timing, at which a suitable stratified mixture gas is formed in a cylinder, through the execution of the additional ignition at the timing substantially the same as the actual injection end timing.

8 Claims, 9 Drawing Sheets

CONTROL DEVICE OF DIRECT INJECTION INTERNAL COMBUSTION ENGINE

CROSS REFERENCE TO RELATED APPLICATION

This application is based on and incorporates herein by reference Japanese Patent Application No. 2007-290224 filed on Nov. 7, 2007.

BACKGROUND OF THE INVENTION

1. Field of the Invention

The present invention relates to a control device of a direct injection internal combustion engine that sets injection start timing of an injector, which injects fuel into a cylinder of the internal combustion engine, and ignition timing of a spark plug such that injection end timing of the injector and the ignition timing of the spark plug have a predetermined relationship.

2. Description of Related Art

In recent years, as one of internal combustion engines mounted in vehicles, there has been a direct injection internal combustion engine having features of low fuel consumption, low exhaust emission, and high output at the same time. In the case of a certain direct injection internal combustion engine (for example, refer to Patent document 1: PCT application Japanese translation publication No. 2003-54186), an injection period of an injector is calculated from a required fuel injection quantity and injection start timing is set with a crank angle based on the injection period such that the injection ends at timing advanced from ignition timing of a spark plug by a predetermined crank angle when fuel pressure is higher than a predetermined value during starting.

The inventor of the present invention is studying a system that ends injection of an injector immediately before a compression top dead center and sets injection start timing and ignition timing such that ignition of a spark plug is performed at timing substantially the same as or immediately after injection end timing (that is, such that the ignition of the spark plug is performed at timing when a suitable stratified mixture gas is formed in the cylinder), thereby stabilizing a combustion state when operating a direct injection internal combustion engine in a compression stroke injection mode (i.e., a mode of injecting fuel into a cylinder in a compression stroke to perform stratified combustion of the fuel). During the study, a following new problem has been found.

Generally, the injection start timing of the injector and the ignition timing of the spark plug are set with the crank angle, but the injection quantity of the injector is set with the injection period (a valve opening period). Therefore, even if the injection start timing and the ignition timing are set with the crank angle beforehand to perform the ignition near the injection end timing as mentioned above, there is a possibility that the injection end timing (a crank angle at timing t1 when the injection period elapses after the injection start timing) deviates toward a delayed crank angle side from the preset ignition timing and the ignition is performed in the middle of the fuel injection (that is, in the middle of formation of a suitable stratified mixture gas in the cylinder) when rotation speed (crank angle speed) of the internal combustion engine rises abruptly during the starting or acceleration of the internal combustion engine as shown in FIG. 12. As a result, the combustion state worsens, causing a misfire and decrease in torque or increase in a HC emission quantity due to incomplete combustion. Such the problems can arise similarly in the technology described in Patent document 1 (that sets the injection start timing such that the injection ends at timing advanced from the ignition timing by a predetermined crank angle).

SUMMARY OF THE INVENTION

It is an object of the present invention to provide a control device of a direct injection internal combustion engine capable of stabilizing a combustion state even when a crank angle at injection end timing deviates toward a delayed crank angle side due to increase in rotation speed of the internal combustion engine.

According to an aspect of the present invention, a control device of a direct injection internal combustion engine sets an injection period of an injector, which injects fuel into a cylinder of the internal combustion engine, in accordance with at least a required fuel injection quantity and sets injection start timing of the injector and ignition timing of a spark plug such that injection end timing of the injector and the ignition timing of the spark plug have a predetermined relationship. The control device has an additional ignition controlling section that performs additional ignition of the spark plug at timing set based on actual injection end timing of the injector when rotation speed of the internal combustion engine increases (e.g., when a peak value of the engine rotation speed increases with every combustion stroke of each cylinder during starting or acceleration).

Thus, even when the crank angle at the injection end timing deviates toward the delayed crank angle side with respect to the preset original ignition timing due to increase in the engine rotation speed, the additional ignition can be performed at timing, at which a suitable stratified mixture gas is formed in the cylinder, through the execution of the additional ignition at the timing set based on the actual injection end timing. Accordingly, the combustion state can be stabilized. Thus, misfire and incomplete combustion can be prevented, thereby inhibiting torque reduction or increase in HC emission quantity.

According to another aspect of the present invention, the additional ignition controlling section performs the additional ignition at timing that is the same as the actual injection end timing of the injector. Thus, the additional ignition can be performed at timing substantially the same as the timing when the fuel injection substantially ends and a suitable mixture gas is formed in the cylinder.

In some cases, depending on the pressure of the fuel supplied to the injector or the like, a certain time is required for the fuel injected into the cylinder to be fully atomized. Therefore, according to another aspect of the present invention, the additional ignition controlling section performs the additional ignition at timing when a predetermined period elapses after the actual injection end timing of the injector. Thus, the additional ignition can be performed when the time, which is necessary for the injected fuel to move to the position suitable for combustion and to be atomized after the end of the fuel injection, elapses and when the suitable mixture gas is surely formed in the cylinder.

According to another aspect of the present invention, the control device has a rotation speed increasing degree determining section, an injection end timing predicting section, and an additional ignition controlling section. The rotation speed increasing degree determining section senses or predicts a rotation speed increasing degree of the internal combustion engine. The injection end timing predicting section predicts the injection end timing of the injector based on the rotation speed increasing degree sensed or predicted by the rotation speed increasing degree determining section. The additional ignition controlling section performs additional ignition of the spark plug at timing set based on the injection end timing predicted by the injection end timing predicting section.

Thus, the ignition timing of the additional ignition can be decided when the injection end timing is predicted. Accordingly, the ignition timing of the additional ignition can be decided at early timing and preparation of the additional ignition (energization to an ignition coil) can be started at early timing. As a result, a time for charging a sufficient ignition energy can be ensured and the additional ignition can be surely performed.

According to another aspect of the present invention, the additional ignition controlling section performs the additional ignition at timing that is the same as the injection end timing predicted by the injection end timing predicting section. Alternatively, according to another aspect of the present invention, the additional ignition controlling section performs the additional ignition at timing when a predetermined period elapses after the injection end timing predicted by the injection end timing predicting section.

The additional ignition may be performed only once. Alternatively, according to yet another aspect of the present invention, the additional ignition controlling section performs the additional ignition a plurality of times at a predetermined interval or at predetermined intervals. Thus, the combustion state can be further stabilized with the multiple times of the additional ignition.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
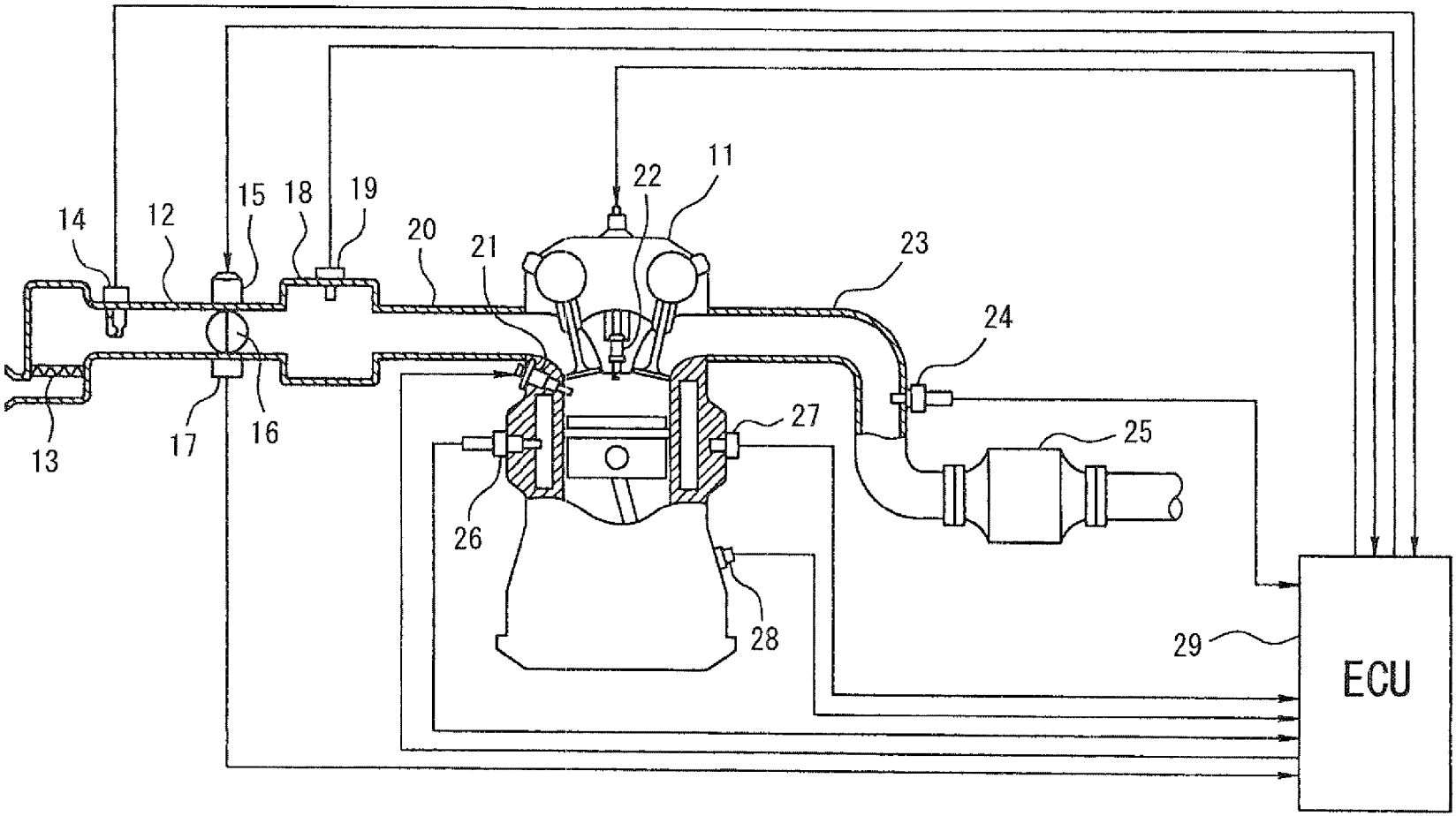
FIG. 1 is a schematic configuration diagram illustrating an engine control system according to a first embodiment of the present invention.

Next, embodiments of the present invention will be described with reference to the drawings.

A first embodiment of the present invention will be described with reference to FIGS. 1 to 5. First, a general configuration of an entire engine control system will be explained with reference to FIG. 1. An air cleaner 13 is provided in the most upstream portion of an intake pipe 12 of a direct injection engine 11 as a direct injection internal combustion engine. An airflow meter 14 for sensing an air intake quantity is provided downstream of the air cleaner 13. A throttle valve 16, whose opening degree is regulated by a motor 15, and a throttle position sensor 17 for sensing an opening degree of the throttle valve 16 (a throttle opening degree) are provided downstream of the airflow meter 14.

A surge tank 18 is provided downstream of the throttle valve 16, and an intake pipe pressure sensor 19 for sensing intake pipe pressure is provided in the surge tank 18. An intake manifold 20 for introducing the air into respective cylinders of the engine 11 is provided to the surge tank 18. Injectors 21 are provided to the respective cylinders of the engine 11 for performing direct injection of the fuel into the cylinders respectively. Spark plugs 22 are fixed to a cylinder head of the engine 11 for the respective cylinders for igniting mixture gases in the cylinders with spark discharge from the respective spark plugs 22.

An exhaust gas sensor 24 (such as an air fuel ratio sensor or an oxygen sensor) for sensing an air fuel ratio, a rich/lean state or the like of exhaust gas is provided in an exhaust pipe 23 of the engine 11. A catalyst 25 such as a three-way catalyst for purifying the exhaust gas is provided downstream of the exhaust gas sensor 24.

A coolant temperature sensor 26 for sensing coolant temperature, a knock sensor 27 for sensing a knocking vibration and a crank angle sensor 28 for outputting a pulse signal every time a crankshaft of the engine 11 rotates by a predetermined crank angle are fixed to a cylinder block of the engine 11. A crank angle and engine rotation speed are sensed based on the output signal of the crank angle sensor 28.

Outputs of the above-mentioned various sensors are inputted to a control circuit 29 (referred to as an ECU, hereinafter). The ECU 29 is structured mainly by a microcomputer. The ECU 29 executes various kinds of engine control programs stored in an incorporated ROM (a storage medium) to control a fuel injection quantity of the injector 21 and ignition timing of the spark plug 22 according to an engine operation state.

In the control, the ECU 29 switches between a compression stroke injection mode (a stratified combustion mode) and an intake stroke injection mode (a homogeneous combustion mode) in accordance with the engine operation state (such as request torque or the engine rotation speed). In the compression stroke injection mode, a small quantity of the fuel is injected directly into the cylinder in a compression stroke, thereby forming a stratified mixture gas near the spark plug 22 and causing stratified combustion (i.e., lean combustion). The compression stroke injection mode exerts effects of improving a fuel consumption and also reducing a quantity of attaching fuel during cold starting or the like. Therefore, in some cases, the compression stroke injection mode is used also during stoichiometric combustion. In the intake stroke injection mode, the fuel injection quantity is increased and the fuel is injected directly into the cylinder during the intake stroke, thereby forming a homogeneous mixture gas and performing homogenous combustion (i.e., stoichiometric combustion or rich combustion). Thus, an engine output is increased.

The ECU 29 executes a fuel injection control routine shown in FIG. 3 and an ignition control routine shown in FIG. 4 (described later) during the compression stroke injection mode, thereby performing fuel injection control and ignition control as follows. That is, a request injection quantity of the injector 21 is calculated based on the engine operation state and the like. An injection period of the injector 21 is calculated based on the request injection quantity and fuel pressure (pressure of the fuel supplied to the injector 21). Injection start timing is set with the crank angle such that the injection of the injector 21 ends immediately before a compression TDC (a compression top dead center) based on the injection period. In addition, the ignition timing is set with the crank angle such that the ignition of the spark plug 22 is performed at timing substantially the same as or immediately after the injection end timing (that is, at timing when a suitable stratified mixture gas is formed in the cylinder). Thus, the injection start timing and the ignition timing are set and then the injection of the injector 21 is performed when the crank angle sensed with the crank angle sensor 28 reaches the injection start timing. Thereafter, the ignition of the spark plug 22 is performed when the crank angle reaches the ignition timing.

Figure 12:
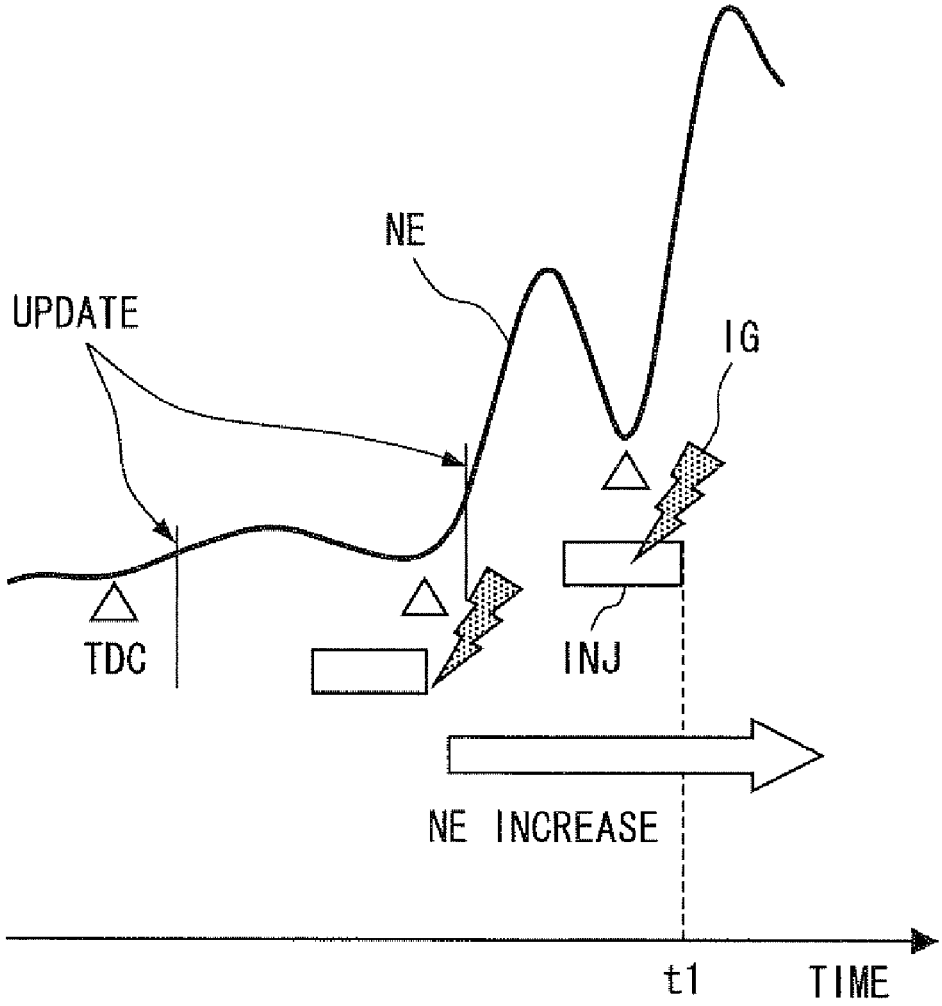
FIG. 12 RELATED ART
FIG. 12 is a time chart illustrating fuel injection control and ignition control of a related art.

Generally, the injection start timing of the injector 21 and the ignition timing of the spark plug 22 are set with the crank angle but the injection quantity of the injector 21 is set with the injection period (a valve opening period). Therefore, even if the injection start timing and the ignition timing are beforehand set with the crank angle such that the ignition is performed near the injection end timing as mentioned above, there is a possibility that the injection end timing (a crank angle at timing t1 when the injection period elapses after the injection start timing) deviates toward a delayed crank angle side with respect to preset ignition timing in the case where the engine rotation speed NE (crank angle speed) increases abruptly during starting or acceleration of the engine 11 as shown in FIG. 12. In such the case, the ignition is performed in the middle of the fuel injection (that is, in the middle of formation of a suitable stratified mixture gas in the cylinder). As a result, the combustion state worsens, causing a misfire and decrease in torque or increase in a HC emission quantity due to incomplete combustion, in FIG. 12 (and also in other drawings), NE represents the engine rotation speed, IG is the ignition, INJ is the injection, and UPDATE is timing for updating the injection start timing.

Figure 2:
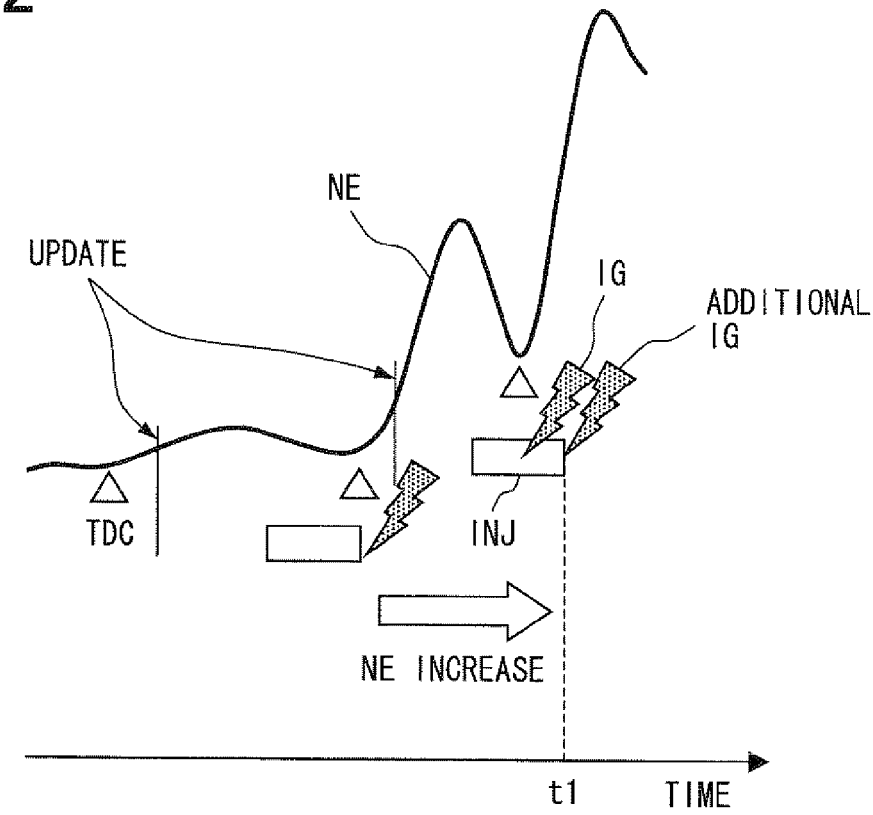
FIG. 2 is a time chart illustrating additional ignition control according to the first embodiment.

As measures against such the problem, the ECU 29 executes an additional ignition control routine shown in FIG. 5 (described in detail later) during the compression stroke injection mode, thereby performing additional ignition control as follows. That is, it is determined that the crank angle at the injection end timing of the injector 21 deviates toward a delayed crank angle side due to engine rotation speed increase when the engine rotation speed NE is increasing (i.e., during starting or acceleration in which a peak value of the engine rotation speed NE increases with every combustion in each cylinder) as shown in FIG. 2. In this case, additional ignition (ADDITIONAL IG in FIG. 2) of the spark plug 22 is performed at timing t1 when a crank angle at actual injection end timing of the injector 21 of a present injection cylinder (a cylinder in which the injection is performed this time) is reached. Alternatively, the additional ignition of the spark plug 22 may be performed immediately before or after the actual injection end timing. Thus, even when the crank angle at the injection end timing deviates toward the delayed crank angle side with respect to the preset original ignition timing due to the increase in the engine rotation speed NE, the combustion state can be stabilized by performing the additional ignition at the timing, at which the suitable stratified mixture gas is formed in the cylinder, through the execution of the additional ignition of the spark plug 22 at the timing substantially the same as the actual injection end timing (that is, the timing the same as or immediately before or after the actual injection end timing).

Figure 3:
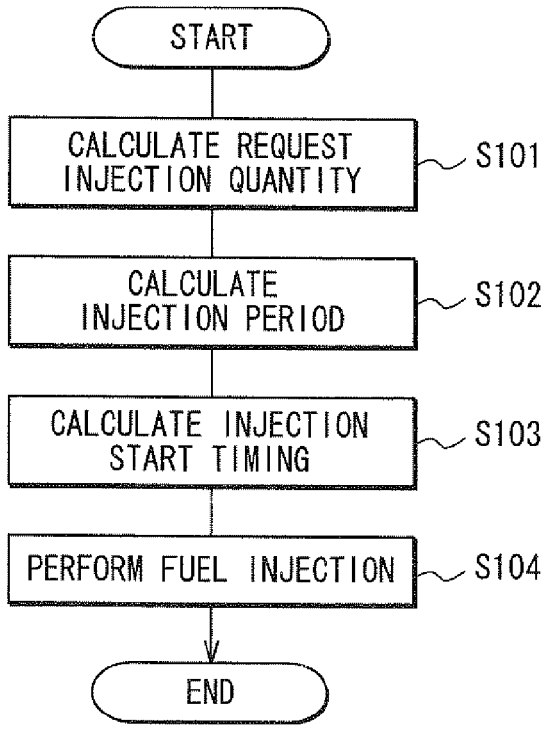
FIG. 3 is a flowchart illustrating a processing flow of a fuel injection control routine according to the first embodiment.
Figure 4:
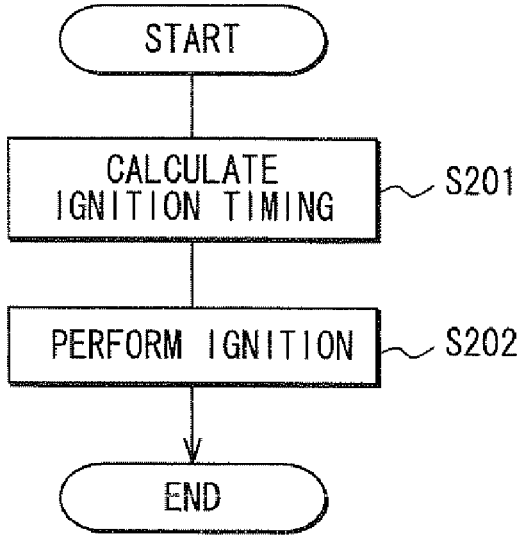
FIG. 4 is a flowchart illustrating a processing flow of an ignition control routine according to the first embodiment.
Figure 5:
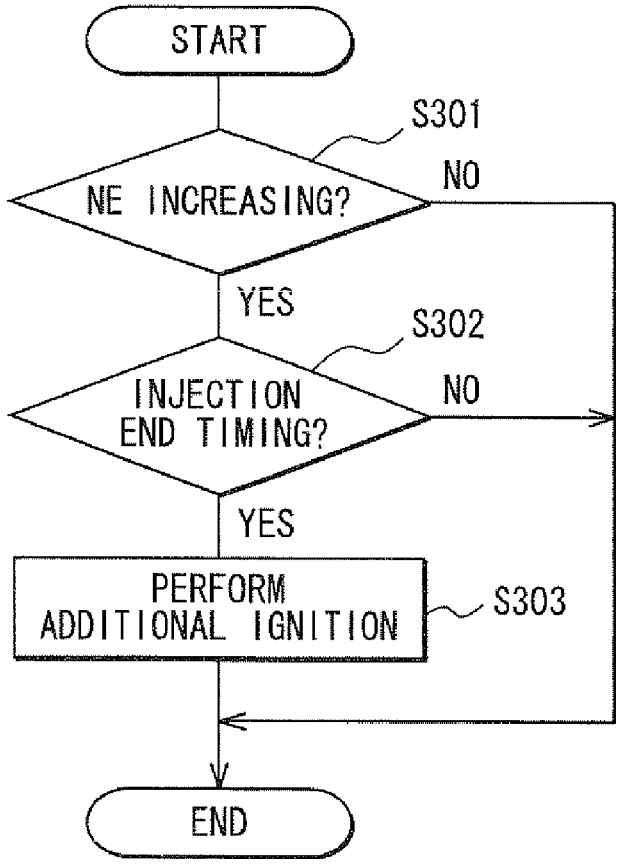
FIG. 5 is a flowchart illustrating a processing flow of an additional ignition control routine according to the first embodiment.

The above-described fuel injection control, the ignition control and the additional ignition control during the compression stroke injection mode are executed by the ECU 29 according to routines shown in FIGS. 3 to 5. Hereafter, processing contents of each of the routines will be explained.

A fuel injection control routine shown in FIG. 3 is performed in a predetermined cycle during the compression stroke injection mode. If the routine is started, first in S101 (S means "Step"), the request injection quantity of the injector 21 is calculated based on the engine operation state and the like. Then, in S102, the injection period of the injector 21 is calculated based on the request injection quantity and the fuel pressure. Then, in S103, the crank angle at the injection start timing is set such that the injection of the injector 21 ends immediately before the compression TDC based on the injection period. Then, in S104, the injection of the injector 21 is performed when the crank angle sensed with the crank angle sensor 28 reaches the injection start timing.

An ignition control routine shown in FIG. 4 is performed in a predetermined cycle during the compression stroke injection mode. If the routine is started, first in S201, the crank angle at the ignition timing is set such that the ignition of the spark plug 22 is performed at timing substantially the same as or immediately after the injection end timing of the injector 21, which is timing immediately before the compression TDC. That is, in S201, the crank angle at the ignition timing is set such that the ignition of the spark plug 22 is performed at timing when a suitable stratified mixture gas is formed in the cylinder. Then, the process proceeds to S202, and the ignition of the spark plug 22 is performed when the crank angle sensed with the crank angle sensor 28 reaches the ignition timing.

An additional ignition control routine shown in FIG. 5 is executed in a predetermined cycle during the compression stroke injection mode and functions as an additional ignition controlling section. If the routine is started, first in S301, it is determined whether the engine rotation speed NE is increasing (i.e., whether there occurs a state where the peak value of the engine rotation speed NE increases with every combustion in each cylinder because the starting or the acceleration is in progress). When it is determined that the engine rotation speed NE is increasing, it is determined that the crank angle at the injection end timing of the injector 21 deviates toward the delayed crank angle side due to the increase of the engine rotation speed NE, and the process proceeds to S302. In S302, it is determined whether the actual injection end timing of the injector 21 of the present injection cylinder is reached based on whether the injector 21 is closed or whether the injection period has elapsed after the injection start timing of the injector 21, for example.

When it is determined that the actual injection end timing is reached in S302, the process proceeds to S303, in which the additional ignition of the spark plug 22 is performed. Alternatively, the additional ignition of the spark plug 22 may be performed immediately before or after the actual injection end timing.

In the above-described first embodiment, the additional ignition of the spark plug 22 is performed at timing substantially the same as (i.e., the same as or immediately before or after) the actual injection end timing of the injector 21 when the engine rotation speed NE is increasing. Therefore, even when the crank angle at the injection end timing deviates toward the delayed crank angle side with respect to the preset original ignition timing due to the increase in the engine rotation speed NE, the additional ignition can be performed when the fuel injection substantially ends and a suitable mixture gas is formed in the cylinder as the additional ignition of the spark plug 22 is performed at the timing substantially the same as the actual injection end timing. Accordingly the combustion state can be stabilized, and the misfire and the incomplete combustion can be prevented, thereby inhibiting the torque reduction or the increase in the HC emission quantity.

In the above-described first embodiment, the additional ignition is performed only once at the timing substantially the same as the actual injection end timing. Alternatively, the additional ignition may be performed multiple times at a predetermined interval or at predetermined intervals. Thus, the combustion state can be further stabilized with the multiple times of the additional ignition.

Figure 6:
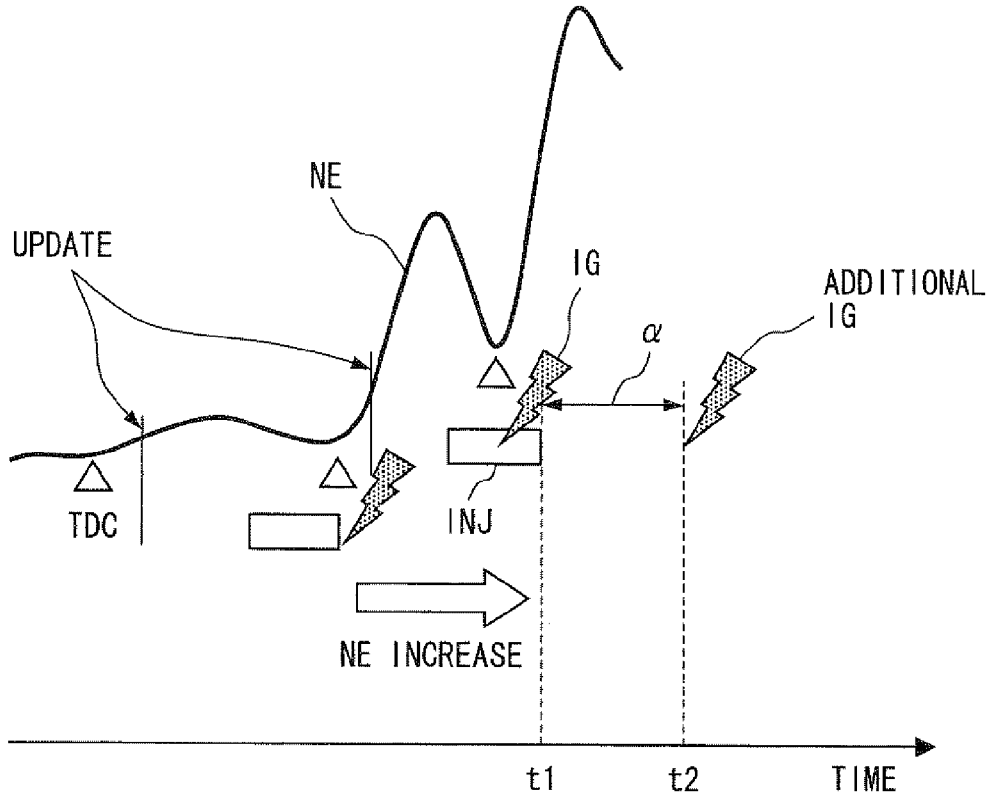
FIG. 6 is a time chart illustrating additional ignition control according to a second embodiment of the present invention.
Figure 7:
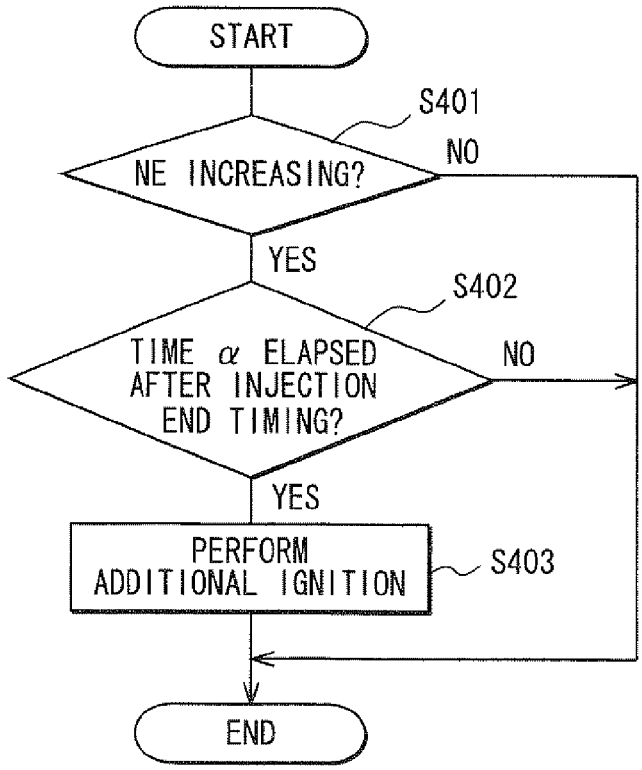
FIG. 7 is a flowchart illustrating a processing flow of an additional ignition control routine according to the second embodiment.

Next, a second embodiment of the present invention will be described with reference to FIGS. 6 and 7. In the following description, differences from the first embodiment will be mainly explained. In some cases, depending on the fuel pressure supplied to the injector 21 or the like, a certain time is necessary for the fuel injected into the cylinder to be fully atomized.

Therefore, in the second embodiment, an additional ignition control routine shown in FIG. 7 (described in detail later) is executed. Thus, the additional ignition of the spark plug 22 is performed at timing t2 when a predetermined time $\alpha$ (for example, a time necessary for the injected fuel to be atomized) elapses after the actual injection end timing t1 of the injector 21.

Hereafter, processing contents of the additional ignition control routine of FIG. 7 will be explained. In the routine, it is determined whether the engine rotation speed NE is increasing in S401. When it is determined that the engine rotation speed NE is increasing, the process proceeds to S402. In S402, it is determined whether a predetermined time $\alpha$ has elapsed after the actual injection end timing t1 of the injector 21 of the present injection cylinder (for example, timing when the injector 21 is closed or the timing when the injection period has elapsed after the injection start timing of the injector 21). The predetermined time $\alpha$ is set to a time necessary for the injected fuel to move to a suitable position and to be atomized after the fuel injection ends. The predetermined time $\alpha$ may be a preset fixed value. Alternatively, the predetermined time $\alpha$ may be changed in accordance with the fuel pressure, the engine rotation speed NE, and the like.

At timing t2 when it is determined that the predetermined time $\alpha$ elapses after the actual injection end timing t1 in S402, the process proceeds to S403, in which the additional ignition of the spark plug 22 is performed.

In the above-described second embodiment, the additional ignition of the spark plug 22 is performed when the predetermined time $\alpha$ elapses after the actual injection end timing t1 of the injector 21. Therefore, the additional ignition can be performed in a state where the period, which is necessary for the injected fuel to move to the suitable position and to be atomized after the fuel injection ends, elapses and where the suitable mixture gas is surely formed in the cylinder.

In the above-described second embodiment, the additional ignition is performed only once when the predetermined time $\alpha$ elapses after the actual injection end timing t1. Alternatively, the additional ignition may be performed multiple times at a predetermined interval or at predetermined intervals. Alternatively, the additional ignition may be performed only once or multiple times at the predetermined interval(s) at the timing substantially the same as the actual injection end timing t1, and then, the additional ignition may be performed only once or multiple times at the predetermined interval(s) again when the predetermined time $\alpha$ elapses after the actual injection end timing t1.

Figure 8:
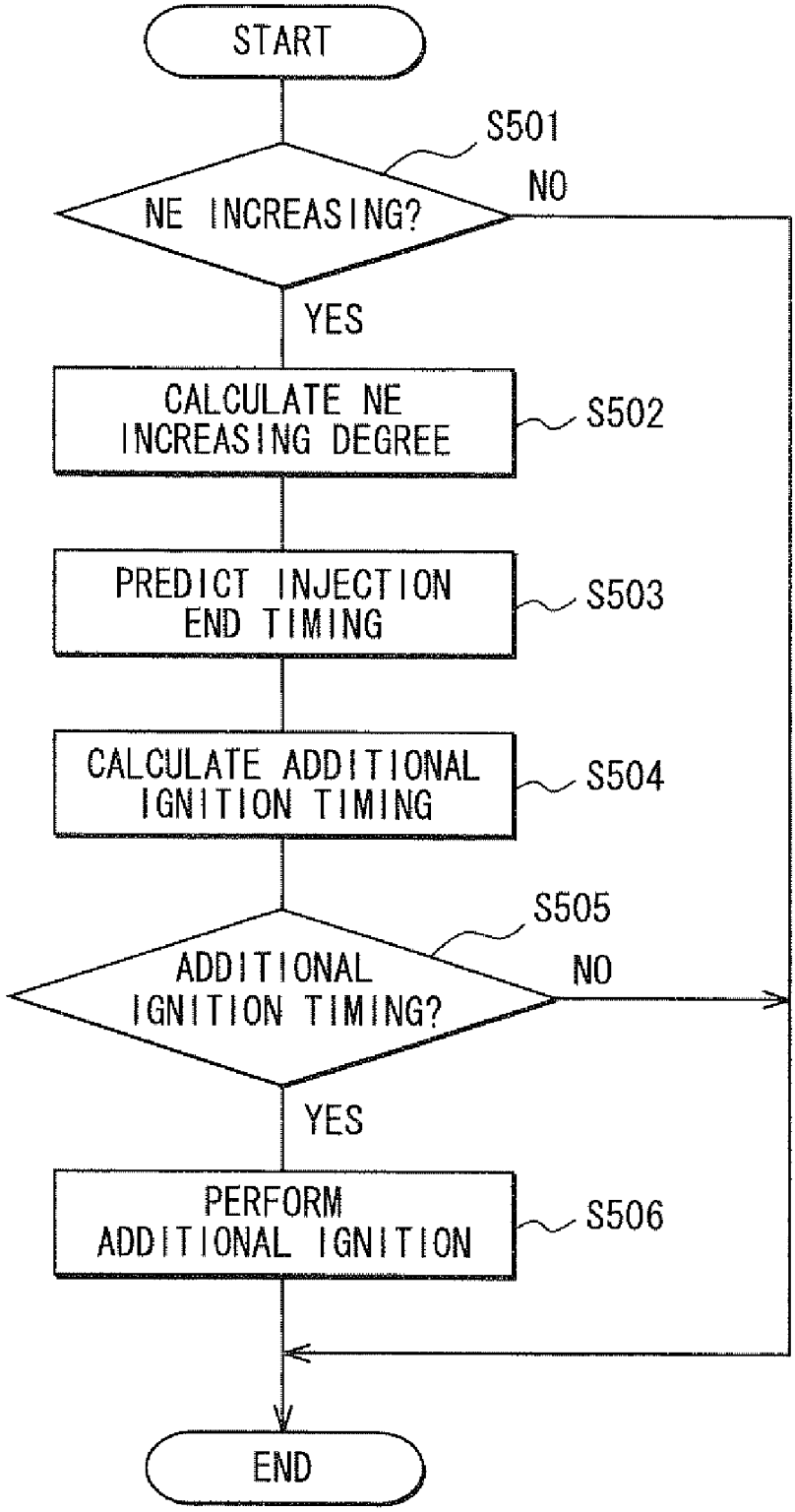
FIG. 8 is a flowchart illustrating a processing flow of an additional ignition control routine according to a third embodiment of the present invention.

Next, a third embodiment of the present invention will be described with reference to FIG. 8. In the following description, differences from the first and second embodiments will be mainly explained.

In the third embodiment, an additional ignition control routine shown in FIG. 8 (described in detail later) is performed. Thus, an engine rotation speed increasing degree (for example, an increase amount of the engine rotation speed NE) due to the present combustion is sensed and the crank angle at the injection end timing of the injector 21 of the present injection cylinder is predicted based on the sensed engine rotation speed increasing degree. Then, the additional ignition is performed at the timing substantially the same as the predicted injection end timing.

Next, processing contents of the additional ignition control routine shown in FIG. 8 will be explained. In the routine, it is determined in S501 whether the engine rotation speed NE is increasing. When it is determined that the engine rotation speed NE is increasing, the process proceeds to S502, in which the engine rotation speed increasing degree due to the present combustion is calculated. In this case, for example, the increase amount of the engine rotation speed NE in a specified time during the engine rotation speed increase is calculated as the engine rotation speed increasing degree. Alternatively, an increasing rate of the engine rotation speed NE (i.e., an acceleration) in a specified time may be calculated as the engine rotation speed increasing degree. The processing of S502 functions as a rotation speed increasing degree determining section.

Then, the process proceeds to S503, in which the crank angle at the injection end timing of the injector 21 of the present injection cylinder is predicted based on the sensed engine rotation speed increasing degree. In this case, for example, a crank angle change amount equivalent to the injection period of the injector 21 is predicted using the sensed engine rotation speed increasing degree, and the crank angle at the injection end timing is predicted by adding the predicted crank angle change amount to the crank angle at the injection start timing. The processing of S503 functions as an injection end timing predicting section.

Then, the process proceeds to S504, in which the predicted crank angle at the injection end timing is set as additional ignition timing. Alternatively, a crank angle immediately before or after the predicted injection end timing may be set as the additional ignition timing. Then, the process proceeds to S505, in which it is determined whether the crank angle sensed with the crank angle sensor 28 reaches the additional ignition timing. When it is determined that the crank angle reaches the additional ignition timing, the process proceeds to S506, in which the additional ignition is performed only once or multiple times at a predetermined interval or predetermined intervals.

In the above-described third embodiment, the engine rotation speed increasing degree due to the present combustion is sensed and the crank angle at the injection end timing of the injector 21 of the present injection cylinder is predicted based on the sensed engine rotation speed increasing degree. Then, the additional ignition is performed at the timing substantially the same as (i.e., the same as or immediately before or after)

the predicted injection end timing. Accordingly, the ignition timing of the additional ignition can be decided when the injection end timing is predicted. Thus, the ignition timing of the additional ignition can be decided at early timing and preparation of the additional ignition (energization to an ignition coil) can be started at early timing, thereby surely performing the additional ignition.

In the above-described third embodiment, the additional ignition is performed only once or multiple times at the predetermined interval(s) at the timing substantially the same as the predicted injection end timing. Alternatively, the additional ignition may be performed only once or multiple times at the predetermined interval(s) when a predetermined time elapses after the predicted injection end timing.

Alternatively, the additional ignition may be performed only once or multiple times at the predetermined interval(s) at the timing substantially the same as the predicted injection end timing, and then, the additional ignition may be performed only once or multiple times at the predetermined interval(s) again when the predetermined time elapses after the predicted injection end timing.

Next, a fourth embodiment of the present invention will be described with reference to FIGS. 9A to 11. In the following description, differences from the first to third embodiments will be mainly explained.

Figure 11:
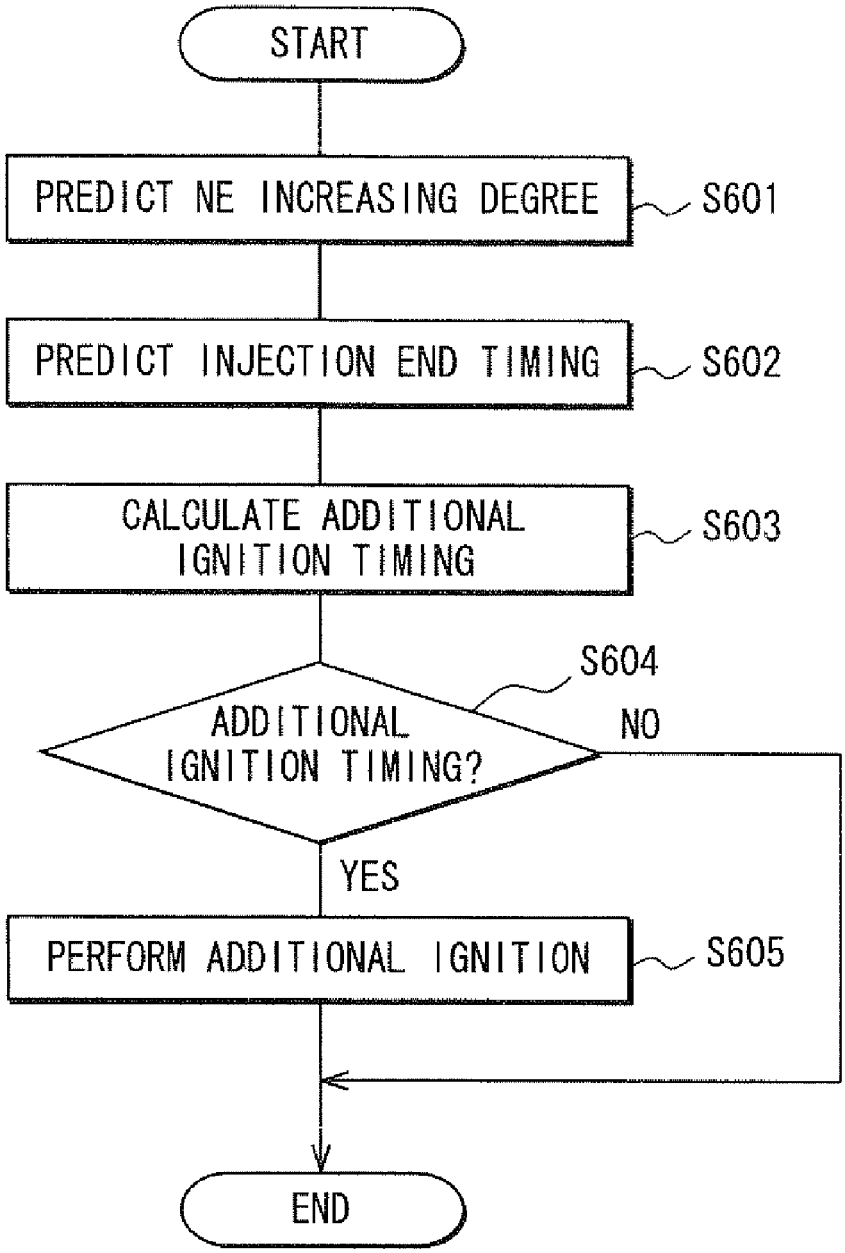
FIG. 11 is a flowchart illustrating a processing flow of an additional ignition control routine according to the fourth embodiment.

In the fourth embodiment, an additional ignition control routine shown in FIG. 11 (described in detail later) is performed. Thus, an engine rotation speed increasing degree (for example, an increase amount of the engine rotation speed NE per specified time) due to next combustion is predicted, and the crank angle at the injection end timing of the injector 21 of a next injection cylinder (in which the injection is performed next) is predicted based on the predicted engine rotation speed increasing degree. Then, the additional ignition is performed at the timing substantially the same as the predicted injection end timing.

Next, a predicting method of the engine rotation speed increasing degree and a predicting method of the injection end timing according to the fourth embodiment will be explained. As shown in FIG. 9A, in the case where the engine rotation speed increasing degree is predicted during the starting, the engine rotation speed increasing degree is predicted in consideration of the increase in the engine rotation speed NE, which accompanies the combustion start at the combustion timing of the cylinder having started the injection first. In this case, for example, the engine rotation speed increasing degree is predicted by calculating the engine rotation speed increasing degree corresponding to the combustion time number and either one or both of present coolant temperature and oil temperature with reference to a map of the engine rotation speed increasing degree (the increase amount of the engine rotation speed NE or the increasing speed of the engine rotation speed NE). The map of the engine rotation speed increasing degree is produced based on experimental data, design data and the like and is stored in the ROM of the ECU 29 or the like in advance. In FIG. 9A, sign A indicates the engine rotation speed increase during the starting, whose degree is to be predicted in the present embodiment.

Alternatively, a physics model (for example, a mathematical expression) modeling a relationship between a combustion energy and either one or both of an intake air quantity and the fuel supply quantity or a physics model modeling a relationship between the combustion energy and generated torque may be used to predict the generated torque from either one or both of the intake air quantity and the fuel supply quantity as the engine rotation speed increasing degree. Alternatively, the generated torque may be predicted with a map, a mathematical expression or the like based on either one or both of the intake air quantity and the fuel supply quantity. Alternatively, the generated torque may be predicted with a map, a mathematical expression or the like based on the combustion time number and either one or both of the coolant temperature and the oil temperature.

Figure 9B:
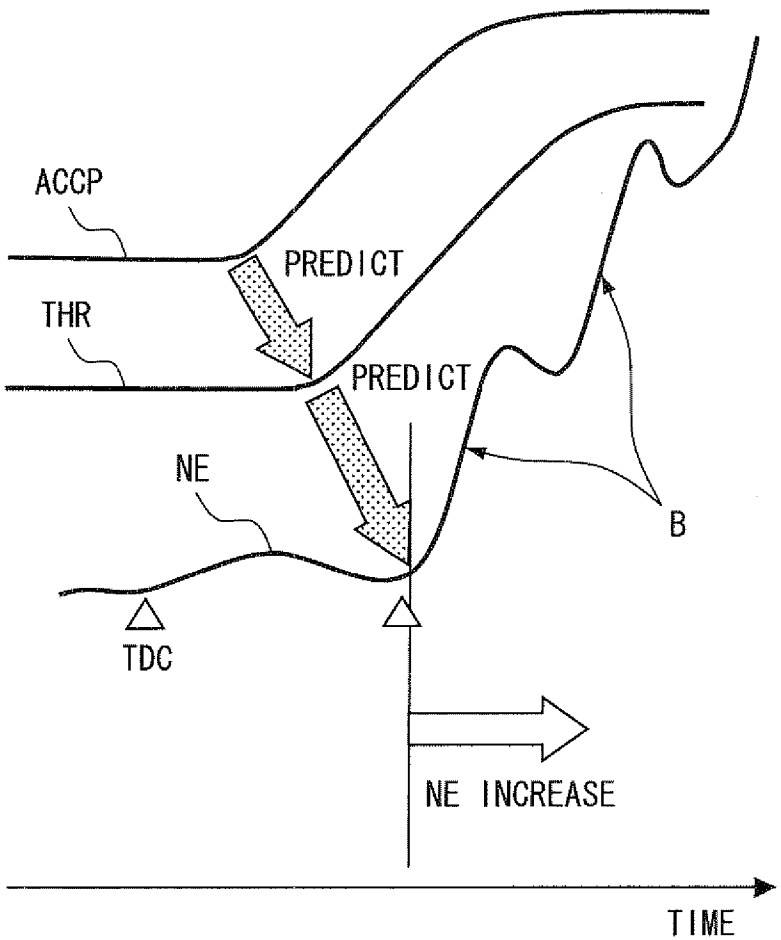
FIG. 9B is a time chart illustrating a prediction method of an engine rotation speed increasing degree during acceleration according to the fourth embodiment.
Figure 9A:
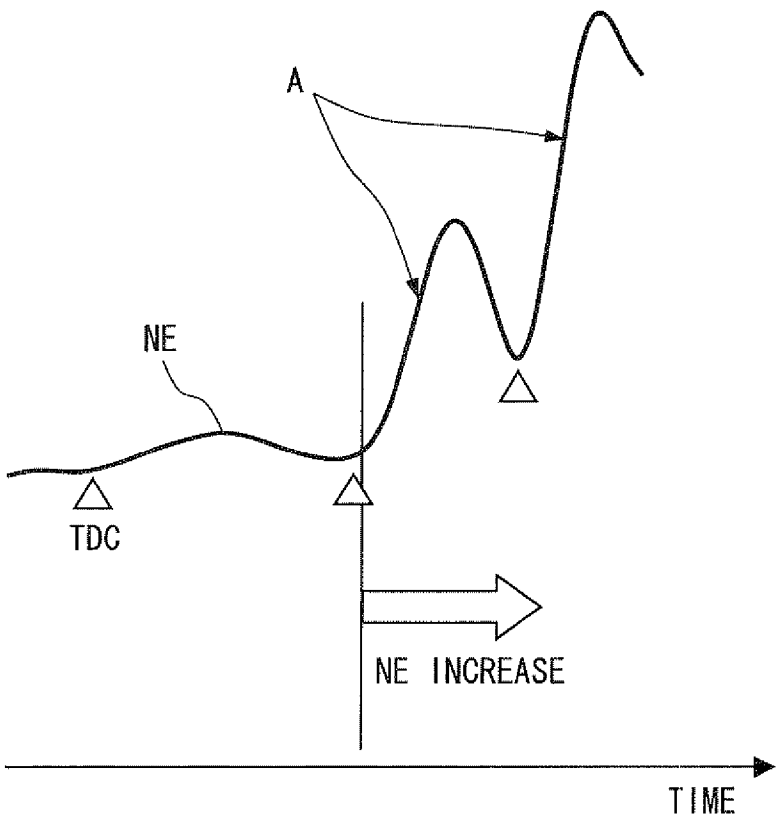
FIG. 9A is a time chart illustrating a prediction method of an engine rotation speed increasing degree during starting according to a fourth embodiment of the present invention.

In the case where the engine rotation speed increasing degree during the acceleration is predicted as shown in FIG. 9B, timing when the engine rotation speed NE increases is predicted based either one or both of the accelerator position ACCP and the throttle opening degree THR with reference to a map, a mathematical expression or the like and also the engine rotation speed increasing degree (the increase amount of the engine rotation speed NE per a specified time or the increasing speed of the engine rotation speed NE) is predicted with reference to a map, a mathematical expression or the like. Alternatively, the throttle opening degree THR may be predicted with reference to a map, a mathematical expression or the like based on the accelerator position ACCP, the timing when the engine rotation speed NE increases may be predicted based on the predicted throttle opening degree THR with reference to a map, a mathematical expression or the like, and the engine rotation speed increasing degree may be predicted with reference to a map, a mathematical expression or the like. In FIG. 9B, sign B indicates the engine rotation speed increase during the acceleration, whose degree is to be predicted in the present embodiment.

Then, the crank angle at the injection end timing of the injector 21 of the next injection cylinder is predicted based on the thus-predicted engine rotation speed increasing timing and engine rotation speed increasing degree. In this case, for example, a crank angle change amount equivalent to the injection period of the injector 21 is predicted based on the predicted engine rotation speed increasing timing and engine rotation speed increasing degree. Then, the predicted crank angle change amount is added to the crank angle at the injection start timing to predict the crank angle at the injection end timing.

Figure 10:
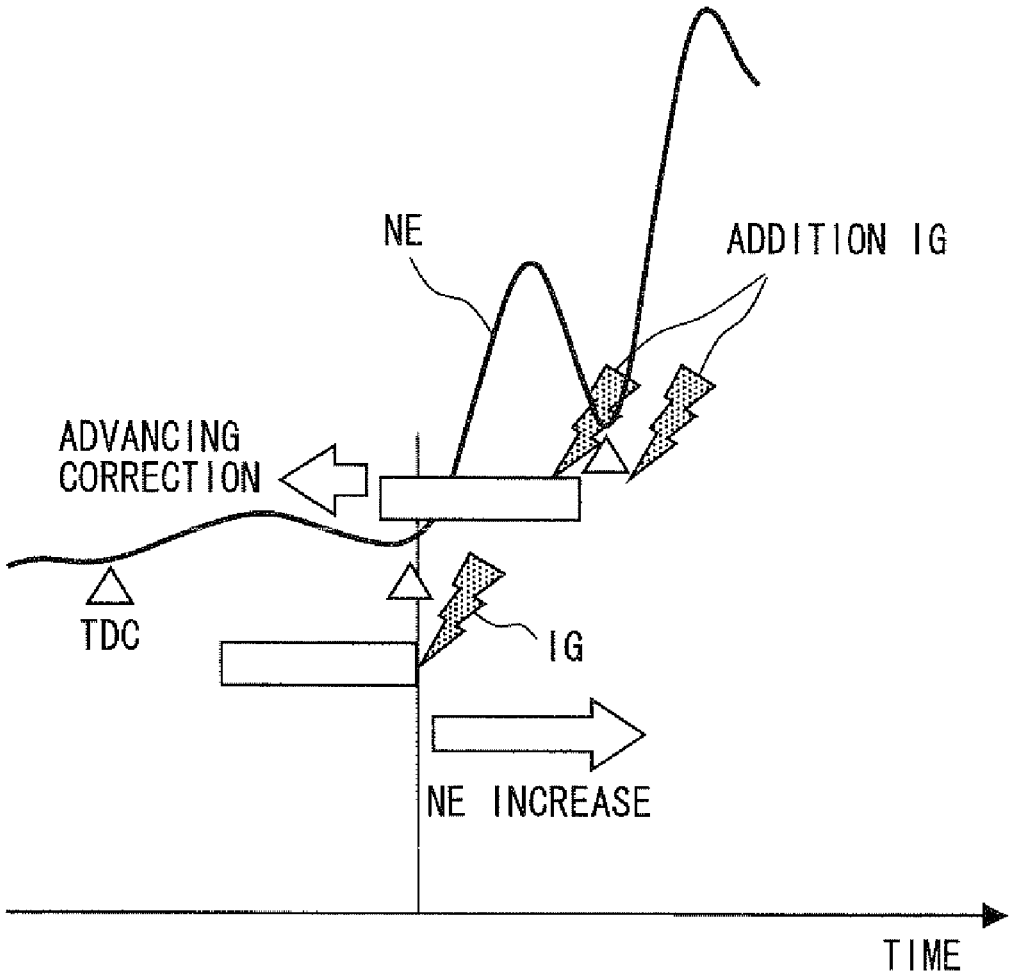
FIG. 10 is a time chart illustrating additional ignition control according to the fourth embodiment.

However, when the request injection quantity is increased and the injection period becomes relatively long, e.g., during the starting or the acceleration, there is a possibility that the crank angle at the predicted injection end timing is on the delayed crank angle side of desired timing (for example, the compression TDC) even if the injection is started at the preset injection start timing and therefore it is difficult to end the injection by the desired timing. In such the case, as shown in FIG. 10, the injection start timing is corrected toward the advanced crank angle side as much as possible, and the injection end timing after correcting the injection start timing toward the advanced crank angle side is predicted.

Next, processing contents of an additional ignition control routine shown in FIG. 11 will be explained. In the routine, in S601, the engine rotation speed increasing timing and the engine rotation speed increasing degree due to the next combustion during the starting or the acceleration are predicted by the methods mentioned above. The processing of S601 functions as a rotation speed increasing degree determining section.

Then, the process proceeds to S602, in which the crank angle at the injection end timing of the injector 21 of the next injection cylinder is predicted based on the predicted engine rotation speed increasing timing and the predicted engine rotation speed increasing degree. In this case, for example, the crank angle change amount equivalent to the injection period of the injector 21 is predicted using the predicted engine rotation speed increasing timing and the predicted engine rotation speed increasing degree, and the crank angle at the injection end timing is predicted by adding the predicted crank angle change amount to the crank angle at the injection start timing. When the crank angle at the predicted injection end timing is on the delayed crank angle side of the desired timing (for example, the compression TDC), the crank angle at the injection start timing is corrected toward the advanced crank angle side as much as possible. Moreover, the crank angle at the injection end timing after the correction of the crank angle at the injection start timing toward the advanced crank angle side is predicted. The processing of S602 functions as an injection end timing predicting section.

Then, the process proceeds to S603, in which the predicted crank angle at the injection end timing is set as additional ignition timing. Alternatively, a crank angle immediately before or after the predicted injection end timing may be set as the additional ignition timing. Then, the process proceeds to S604, in which it is determined whether the crank angle sensed with the crank angle sensor 28 reaches the additional ignition timing. When it is determined that the crank angle reaches the additional ignition timing, the process proceeds to S605, in which the additional ignition of the spark plug 22 is performed only once or multiple times at a predetermined interval or predetermined intervals.

In the above-described fourth embodiment, the engine rotation speed increasing degree due to the next combustion is predicted. Then, the crank angle at the injection end timing of the injector 21 of the next injection cylinder is predicted based on the predicted engine rotation speed increasing degree. Then, the additional ignition is performed at the timing substantially the same as (i.e., the same as or immediately before or after) the predicted injection end timing. Accordingly, the ignition timing of the additional ignition can be decided at earlier timing and preparation of the additional ignition (energization to the ignition coil) can be started at earlier timing, thereby performing the additional ignition more surely.

In the above-described fourth embodiment, the additional ignition is performed only once or multiple times at the predetermined interval(s) at the timing substantially the same as the predicted injection end timing. Alternatively, the additional ignition may be performed only once or multiple times at the predetermined interval(s) when a predetermined time elapses after the predicted injection end timing. Alternatively, the additional ignition may be performed only once or multiple times at the predetermined interval(s) at the timing substantially the same as the predicted injection end timing, and then, the additional ignition may be performed only once or multiple times at the predetermined interval(s) again when the predetermined time elapses after the predicted injection end timing.

In each of the above-described first to fourth embodiments, the additional ignition control is performed during the compression stroke injection mode of injecting the fuel into the cylinder during the compression stroke. Alternatively, the additional ignition control may be performed during an intake-compression stroke injection mode of injecting the fuel into the cylinder in both of the intake stroke and the compression stroke.

The present invention can be also applied to a dual injection engine having both of an injector for intake port injection and an injector for direct injection and implemented.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A control device of a direct injection internal combustion engine, the control device comprising:

an injection period setting means for setting an injection period of an injector, which injects fuel into a cylinder of the internal combustion engine, in accordance with at least a required fuel injection quantity;

a timing setting means for setting injection start timing of the injector and ignition timing of a spark plug such that injection end timing of the injector and the ignition timing of the spark plug have a predetermined relationship; and an additional ignition controlling means for performing additional ignition of the spark plug at timing set based on actual injection end timing of the injector when rotation speed of the internal combustion engine increases.

2. The control device as in claim 1, wherein the additional ignition controlling means performs the additional ignition at timing that is the same as the actual injection end timing of the injector.

3. The control device as in claim 1, wherein the additional ignition controlling means performs the additional ignition at timing when a predetermined period elapses after the actual injection end timing of the injector.

4. The control device as in claim 1, wherein the additional ignition controlling means performs the additional ignition a plurality of times at a predetermined interval or at predetermined intervals.

5. A control device of a direct injection internal combustion engine that sets an injection period of an injector, which injects fuel into a cylinder of the internal combustion engine, in accordance with at least a required fuel injection quantity and that sets injection start timing of the injector and ignition timing of a spark plug such that injection end timing of the injector and the ignition timing of the spark plug have a predetermined relationship, the control device comprising:

a rotation speed increasing degree determining means for sensing or predicting a rotation speed increasing degree of the internal combustion engine;

an injection end timing predicting means for predicting the injection end timing of the injector based on the rotation speed increasing degree sensed or predicted by the rotation speed increasing degree determining means; and an additional ignition controlling means for performing additional ignition of the spark plug at timing set based on the injection end timing predicted by the injection end timing predicting means.

6. The control device as in claim 5, wherein the additional ignition controlling means performs the additional ignition at timing that is the same as the injection end timing predicted by the injection end timing predicting means.

7. The control device as in claim 5, wherein the additional ignition controlling means performs the additional ignition at timing when a predetermined period elapses after the injection end timing predicted by the injection end timing predicting means.

8. The control device as in claim 5, wherein the additional ignition controlling means performs the additional ignition a plurality of times at a predetermined interval or at predetermined intervals.

* * * * *